United States Patent [19]

Bolz et al.

[11] Patent Number: 4,561,316

[45] Date of Patent: Dec. 31, 1985

[54] STARTER FOR INTERNAL COMBUSTION ENGINES

[75] Inventors: Ludwig Bolz, Waiblingen; Walter Rühle, Korntal, both of Fed. Rep. of Germany

[73] Assignee: Robert Bosch GmbH, Stuttgart, Fed. Rep. of Germany

[21] Appl. No.: 723,003

[22] Filed: Apr. 16, 1985

Related U.S. Application Data

[63] Continuation of Ser. No. 500,975, Jun. 3, 1983, abandoned.

[30] Foreign Application Priority Data

Jul. 10, 1982 [DE] Fed. Rep. of Germany ..... 3225957

[51] Int. Cl.[4] ..... F02N 11/00

[52] U.S. Cl. ..... 74/7 E; 74/7 A; 74/411; 74/801

[58] Field of Search ..... 74/7 A, 7 E, 411, 785, 74/801; 290/38 R

[56] References Cited

U.S. PATENT DOCUMENTS

| | | | |
|---|---|---|---|
| 3,081,648 | 3/1963 | Duer | 74/801 |
| 3,583,825 | 6/1971 | Sadler | 74/801 X |
| 4,192,195 | 3/1980 | Kazino et al. | 74/7 A |

FOREIGN PATENT DOCUMENTS

| | | | |
|---|---|---|---|
| 1231219 | 9/1960 | France . | |
| 2447487 | 8/1980 | France . | |
| 2514425 | 4/1983 | France . | |
| 165663 | 10/1982 | Japan | 74/7 E |
| 2107425 | 4/1983 | United Kingdom . | |

*Primary Examiner*—Stephen F. Husar

*Attorney, Agent, or Firm*—Frishauf, Holtz, Goodman & Woodward

[57] ABSTRACT

To prevent transfer of firing or ignition shocks or jolts, and variations in torque transmitted due to compression and decompression of the driven pistons of an IC engine from causing damage to the starter motor, in which the starter motor includes a planetary gearing, (20-25-27), the annulus, or ring gear (20) of the planetary gearing is held in an intermediate bearing structure (10) extending transversely to the starter motor by elastic cushions, or pillows or plugs (18), fitted in recesses (17) of the intermediate bearing structure, and coupled to the annulus, or ring gear (20) by projecting stubs or pins (21) extending radially into openings (19) formed in the cushions or plugs.

16 Claims, 2 Drawing Figures

STARTER FOR INTERNAL COMBUSTION ENGINES

This application is a continuation of application Ser. No. 500,975, filed June 3, 1983, now abandoned.

The present invention relates to a starter for an internal combustion engine and more particularly to a starter motor structure in which the starter includes an internal gearing so that the motor portion of the starter, and the drive pinion portion of the starter operate at different speeds.

BACKGROUND

Various types of starter motors have been proposed, in which a gearing or transmission is interposed between the motor element and drive pinion. A typical gearing for this purpose utilizes a planetary gear drive, positioned intermediate of the starter motor assembly, and, for example, secured to an intermediate separating plate which mechanically separates the motor portion from the engagement mechanism coupling the drive pinion of the starter motor to the drive shaft thereof. In starter motors which include a transmission gearing, it has been customary to secure the annulus, or ring gear of a planetary gearing in the separating plate, which, also, carries an intermediate central bearing for the starter motor. Geared starters have the disadvantage that the rotating elements thereof are highly stressed since the loading placed on the starter by the internal combustion (IC) engine, to which it is coupled during starter operation, is non-uniform. Due to compression and decompression of gases within the cylinder-piston combinations of the IC engine, rotary shocks are transmitted back from the engine to the starter which, due to the amplification effect of the gearing, may lead to structural distortion of the components of the starter which are subjected to the shocks or impact. These impacts or shocks occur in the form of torque jumps or shocks and may lead to breakage of elements which transfer the torque shocks, for example the drive pinion, and the component of the transmission gearing. This danger due to damage of the starter caused by shocks being transmitted thereto is particularly acute in starter motors which utilize transmission gearing, since, due to the gear step-up ratios, the shock forces appear in amplified manner, due to the increased speed of the portions which transfer the torque from the starter motor to the gearing within the starter, as well as to the drive pinion thereof.

THE INVENTION

It is an object to improve a starter motor with internal gearing in which transmission of shocks from the IC engine to the starter is effectively prevented to thereby improve overall starting operation.

Briefly, the outer, or annulus or ring gear of a planetary drive, that is, the gear portion which carries the internal gearing, is resiliently secured in the housing of the starter, for example in the support element for the central bearing thereof, so that the normally fixed annulus, or ring gear can temporarily deflect from its ordinary fixed position within the starter.

In accordance with a preferred feature of the invention, the deflection is permitted by placing rubber shock bushings, or the like, between recesses formed in the ring gear structure and matching recesses within the housing—typically the bearing holding plate—of the starter, the rubber bushings normally holding the ring gear structure in centered, aligned position within the housing, but permitting compression of the bushings to absorb shocks which are being transmitted to the gearing from the drive pinion, in engagement with an IC engine, then being started.

The structure has the advantage that torque peaks, shocks, and other non-uniformities of torque being transmitted, for example due to compression, and decompression of cylinders of the internal combustion (IC) engine will be damped, so that the danger of breakage of the components of the starter motor which transfer torques is largely eliminated. Additionally, the starter, in operation, will have substantially smoother running speed, without substantial variation of the speed as the IC engine is being started, which decreases wear-and-tear on the armature, the commutator of the starter motor, and the brushes thereof.

By placing bushings between the ring gear, or annulus of the planetary drive and the fixed housing, the additional advantage can be obtained that shocks are being damped and, directly, affect the components of the transmission which transfer torque. Permitting these components to move, slightly, without, however, interrupting torque transmission permits absorption of shocks and torque peaks, without interfering of starting operation. Further, and particularly by using rubber bushings located in recesses of the ring gear and the housing, respectively, the overall length of the structure is not increased; nor are structural elements required which cannot be readily obtained as articles of commerce, or which necessitate complex assembly steps or require special tools.

In accordance with a particularly preferred feature of the invention, the damping elements, typically rubber bushings, are located between the bearing structure intermediate the starter and the annulus, or ring gear, so that the annulus may slightly move with respect to the bearing holding structure and/or a cover or separating disk between the electrical and components of the starter and the clutch or engagement structure for the pinion which drives the starter of the IC engine. The arrangement readily permits to form the cover plate with guide beads or ridges for the planetary wheels of the planet gearing, thus further contributing to positive engagement of the wheels without, however, being subjected to substantial shock due to the possibility of movement of the annulus or ring gear.

DRAWINGS

FIG. 1 is a longitudinal schematic sectional view through a starter of essentially standard construction, and incorporating the present invention; and FIG. 2 is a longitudinal sectional view along line II—II of FIG. 1.

DETAILED DESCRIPTION

Figure 1:
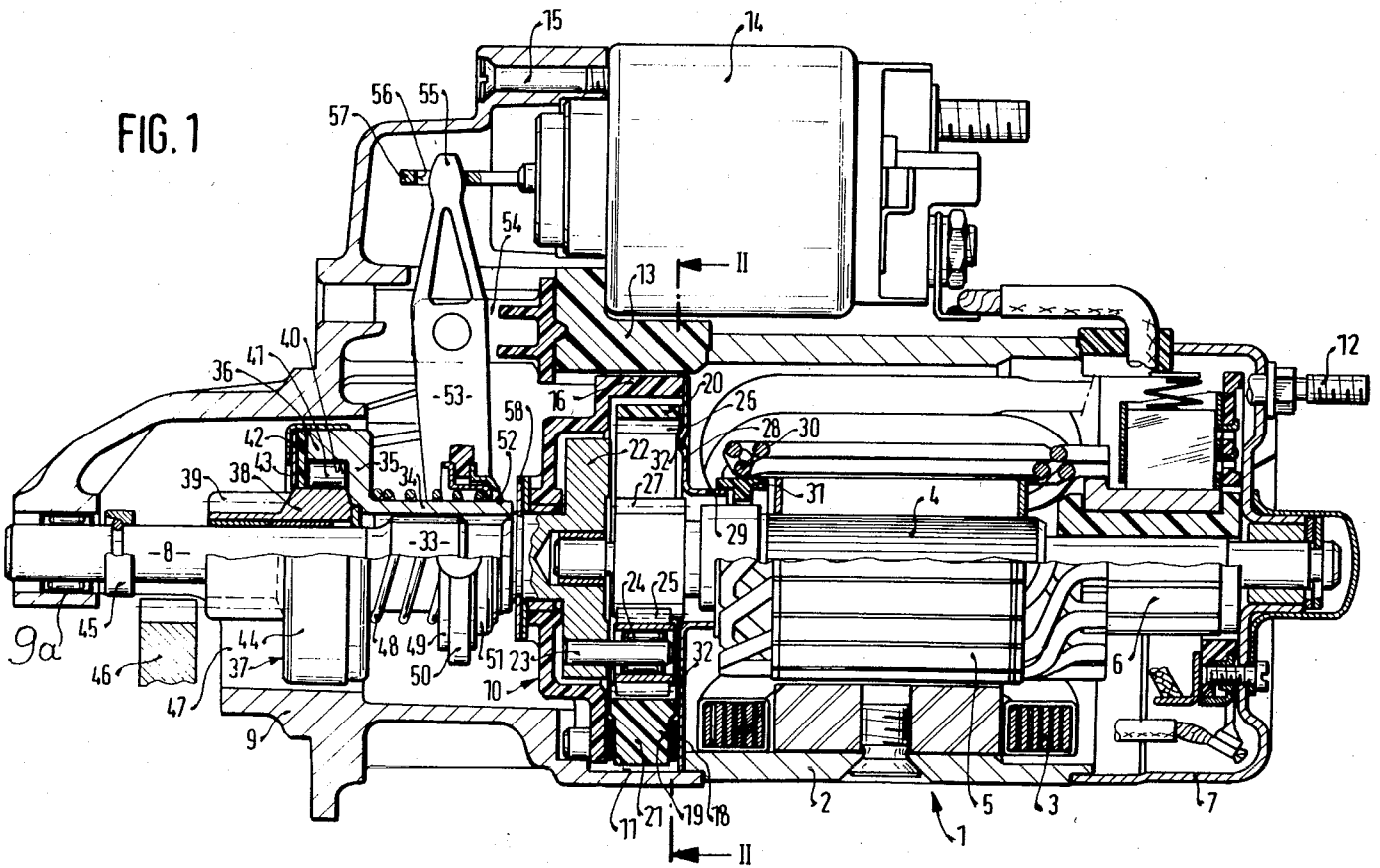

The basic structure of the starter is standard, and in accordance with many well known and commerical starter structures. The starter has a motor 1 within a housing 2, in which an exciter or field winding 3 is positioned. The starter motor 1 has a motor shaft 4 on which an armature 5 and a commutator 6 are located. The motor shaft 4 is retained in a bearing formed at a bearing cover or commutator shield 7, located adjacent the commutator 6. The other end of the shaft 4 of the motor rotor is journalled in a blind bore of a drive shaft 8.

Figure 2:
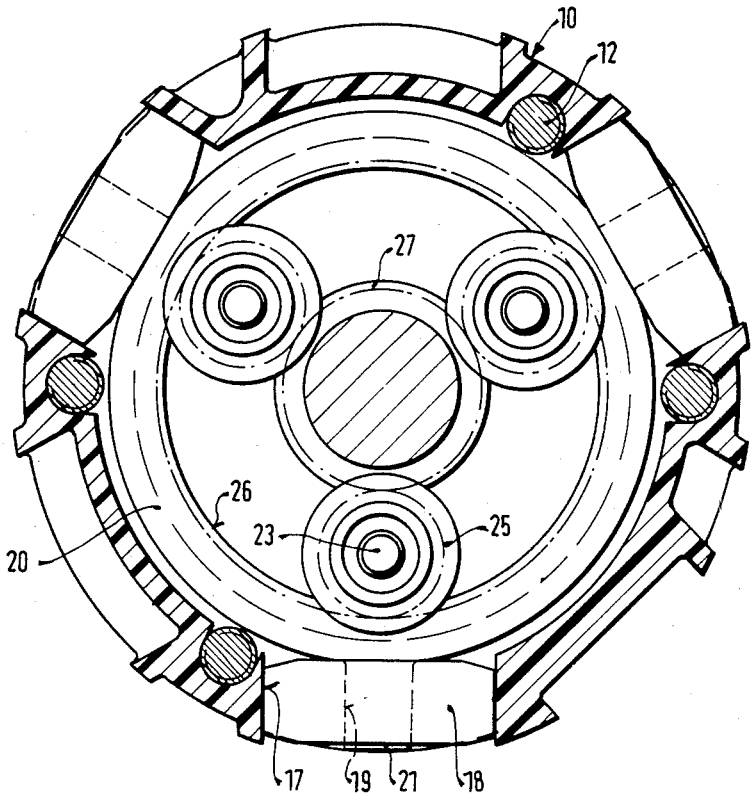

The drive shaft 8 is journalled in a drive shaft bearing 9*a*, secured in a drive housing structure 9. The drive housing structure 9 is secured to the housing 2 of the motor, for example by flanges and screw connections. The right end of the drive shaft 8—with reference to FIG. 1—is rotatably received in an intermediate bearing structure 10. Intermediate bearing structure 10 is fitted into an enlarged portion 11 of the drive housing structure 9. The end faces of the housing 2 receives the bearing cover 7 and the drive housing structure 9, with the intermediate bearing holding structure 10. The assembled elements are secured together by tension bolts 12 (FIG. 2). The starter engagement relay 14 is secured to the housing structure by screws 15 with interposition of a sealing element 13. As shown, the relay is directly secured to the drive housing structure 9.

The intermediate bearing structure 10 is a cup-shaped element made, for example and preferably, of plastic material, for example a polyamide-type plastic. The intermediate bearing structure 10 has a cylindrical rim 16 formed with three slits or openings 17, respectively offset by 120° (see FIG. 2).

In accordance with the invention, a shock and vibration accepting damping element is inserted in each one of the slits 17. The vibration damping element is constructed as an elastic cushion or plug 18, for example made of rubber, or similar elastomer. The cushion, or pillow, or plug 18 has a rectangular opening 19 therein. Each one of the openings 19 have central axes which are located in a plane transverse to the longitudinal axes of the intermediate bearing structure 10, and hence to the axis of rotation of shafts 4, 8. They intersect at the axis of rotation of the shaft 4, 8.

The intermediate bearing structure 10 retains the ring gear 20 of a planetary gearing. The ring gear 20 is, preferably, an injection molded element made of plastic, for example, polyamide. In accordance with the feature of the invention, three holding stubs, or pins 21 extend radially outwardly from the internal tooth gear ring 20, relatively spaced from each other by 120°. The stubs or pins 21 extend into and are fitted in the openings 19 of the elastomer cushions or plugs or pillows 18 fitted in the respective receiving openings or slits 17 formed in the holding portion of the intermediate bearing structure 10. Consequently, the ring gear 20 is received in the intermediate bearing structure 10 by elastically deformable cushions 18, and thus resiliently held in the intermediate bearing structure. It can move, within the limits of elastic deflection of the plugs, or pillows, or cushions 18 with respect to the intermediate bearing structure 10. The end of the drive shaft 8 which extends into the intermediate bearing structure 10 is formed as a flange 22, which, simultaneously, forms the planet wheel carrier, or spider. Three shafts 23, located parallel to the longitudinal axis of the starter, and spaced 120° with respect to each other, extend from the flange 22. Each one of the shafts 23 retains a planet wheel 25 with an interposed bearing, preferably a roller bearing 24. The planet wheels 25 are in engagement with the inner gearing 26 of the ring gear or annulus 20. The end of the motor shaft 4, which is rotatably supported within the drive shaft 8, is formed with a gear section 27, forming a sun gear for the planetary gearing in engagement with the gear teeth of the planet wheels 25.

A cover plate 28 of sheet metal separates the planetary gearing from the starter motor. The cover plate, or disk 28 is clamped with its outer edge between the facing ends of the intermediate bearing structure 10 and the housing 2 of the starter motor. The cover plate is dimensioned to cover the slits 17 which retain the cushions, or plugs 18 of elastic material, and, preferably, is in engagement with these cushions or plugs 18. The cover plate has a sleeve-like extension 29 with surrounds a portion of the drive shaft 4 close to the gear section 27 thereon. The sleeve 29 extends into a sealing ring 31, which has a T-shaped cross section, and which is inserted into the winding overhang 30 of the armature 5. Effective separation of the mechanical structure, and particularly the structure which is subject to contamination, and exposure to ambient conditions from the electric portion of the starter is insured by a simple and easily assembled seal.

The cover plate 28 is formed with a ring-shaped projection 32 at the side facing the planetary gearing. The planet wheels 25 engage, laterally, with the projection or ring-shaped bead 32. The bead 32 is so located that it engages the planet wheels 25 in a region close to the roots of the gear teeth thereof at the side which is remote from the longitudinal axis of the planetary gearing, and hence of the sun gear 27.

The drive shaft 8 has a high-pitch thread portion 33, on which a driver 34 is placed. Driver 34 is unitary with an outer ring 36 of an overrunning clutch 37, connected thereto by a flange 35. An inner ring 38 is formed as a projection of a starter pinion 39, positioned to mesh with the flywheel ring gear 46 of an IC engine. The pinion 39 is seated rotatably and longitudinally movable on the drive shaft 8. The rings 36, 38 define, between themselves, spaces 40 in which rollers 41 and associated springs—not further shown—are located. A cover plate 42 closes the chambers or spaces 40. A shim or compensating washer 43 is located adjacent the outer end face of the structure. A cover 44 retains the respective overrunning clutch elements 36, 38, 41, 42, 43 in position.

An abutment or stop ring 45 is located close to the end of the shaft 8 which is journalled in the bearing 9*a*. The ring gear 46 of the IC engine is positioned close to the abutment ring 45. The end portion of the shaft 8, and the bearing 9*a* are held in position by a projecting cantilever projection from the drive housing 9. The ring gear 46 extends into the opening 47 formed by the cantilever projection of the structure 9, or, if the structure 9 is enclosed-ring shape through an opening cut therein, to permit engagement of the ring gear 46 with the starter pinion 39 if the starter pinion is shifted toward the left (FIG. 1) from the position shown.

A meshing spring 48 is secured to the driver 34 located between the flange 35 and a first abutment element 49, loosely arranged on the driver 34. A driver disk 50 is located between the first abutment element 49 and a second abutment element 51, for axial and radial movement. The second abutment element 51 engages with an abutment ring 52 of the driver 34. The driver disk 50 is linked to a shift or engaging lever 53. The shift lever 53 is pivoted on a fixed portion of the drive housing 9, and fitted in a recessed form therein. The free end 55 of the lever 53 extends into a slit 56 of a switching rod 57 coupled to the magnetic armature of the starter relay 14.

A braking disk 58 is located at the facing side of the bearing structure 10, facing the driver 34. The braking disk 58 has a wear-resistant brake surface coating or cover thereon. The brake disk 58, together with the facing side of the driver 34 form a run-out, or overrun brake upon disconnection of the starter subsequent to starting of the IC engine.

OPERATION

When the starter relay is engaged, and the starter energized, so that the pinion 39 is coupled to the flywheel ring gear 46, shocks due to compression, decompression, and subsequent ignition within the cylinders of the IC engine will be transferred from the flywheel ring gear 46 to the rotating portions and components of the starter motor, and all the intermediate torque transmitting elements. These portions and elements are the pinion-engaging or meshing drive, formed by the starter pinion 39, the overrunning clutch 37, the driver 34, the drive shaft 8, the high-pitch thread portion 33, and all the gear elements of the planetary drive. These gear elements are the planet wheels 25, secured to the drive shaft 8, which are engaged with the ring gear 20 as well as with the pinion 27 of the rotor shaft 4 of the starter motor 1. Any one of these elements may become damaged, or fracture; the elements which are particularly subject to damage are the gears and gear teeth of the planetary gearing. The planetary gearing has the tendency to transform loading and torque variations into larger forces and more rapid change of rotary speeds at higher rotary speeds. In accordance with the invention, the resilient support 18 for the annulus, or ring gear 20 of the planetary gearing on, and in the intermediate bearing structure 10 provides for damping of those shocks and jolts. The shock absorbing plugs, pillows, or cushions 18 thus form a shock absorbing interposed element within the chain of transmission of torque between the flywheel ring gear 46 and the engaged pinion 39 and the rotor 4, 5, 6 of the starter motor 1 including the planetary gearing. The mechanical connection between the drive shaft 8 and the rotor shaft 4 no longer is a stiff, completely rigid connection but, rather, permits resilient absorption of shocks or jolts. The cushions or pillows 18 interposed between the ring gear 20 and the bearing structure 10 therefor thus permit absorption of ignition shocks, compression and decompression vibrations and shocks and the like by the action of the elastic cushion elements, thus preventing damage to the non-yielding, rigid components of the starter motor, typically the pinion-engaging or meshing drive and components thereof to the left of the intermediate bearing structure 10 as well as the electrical components of the rotor 4, 5, 6 of the starter motor, while, additionally, protecting the components of the planetary gearing.

Various changes and modifications may be made within the scope of the inventive concept.

What is claimed is:

1. Starter motor unit for an internal combustion engine having a dynamo electric machine including a housing structure (2, 9, 10);

a stator (3) and a rotor including a rotor shaft (4) an armature (5) secured to the shaft;

a drive shaft (8);

a starter pinion (39) rotatably and longitudinally movable on the drive shaft located for engagement with a flywheel ring gear (46) of the internal combustion engine;

a meshing drive (33, 34, 37) for selectively engaging the pinion (39) with the flywheel ring gear (46);

a planetary gearing (20, 22, 23, 25, 27) coupling the rotor shaft (4) and the drive shaft (8);

and a separating plate (28) separating the dynamo electric machine (1) and the planetary gearing;

and comprising, in accordance with the invention damping means (18) secured to the ring gear or annulus (20) of the planetary gearing and resiliently securing said ring gear or annulus of the planetary gearing within the housing structure.

2. Unit according to claim 1 wherein an intermediate bearing structure (10) is provided, located axially to the motor shaft between the ends of the housing structure (2 and 9) and includes a cup-shaped bearing shell open towards said separating disk (28);

said cup-shaped bearing shell being secured to and within said housing;

and wherein the damping means (18) are located in said cup-shaped bearing shell and facing said separating plate.

3. Unit according to claim 2 wherein the cup-shaped shell is formed with openings or recesses (17);

and said damping means are fitted in said openings or recesses.

4. Unit according to claim 2 wherein the damping means (18) are coupled, respectively, to the cup-shaped bearing shell and to the ring gear or annulus for resiliently coupling said ring gear or annulus in resiliently deflectable essentially fixed position within the housing.

5. Unit according to claim 1 wherein the damping means comprises elastic cushions or plugs.

6. Unit according to claim 3 wherein the damping means comprises elastic cushions or plugs.

7. Unit according to claim 4 wherein the damping means comprises elastic cushions or plugs.

8. Unit according to claim 1 further including an intermediate bearing structure (10) extending transversely to the axis of rotation of the drive shaft (8);

and holding means (17) formed on said intermediate bearing structure engageable with said damping means (18) to retain the ring gear or annulus (20) in resiliently, damped but essentially fixed position concentrically with said drive shaft (8).

9. Unit according to claim 8 wherein said holding means comprise recesses or openings (17) formed in the intermediate bearing structure;

the damping means comprises plug or cushion or pillow elements fitted in said openings or recesses;

said plug or pillow or cushion elements being formed radially extending openings (19);

and wherein the ring gear or annulus is formed with radially extending stubs, or pins (21) fitted into the radially extending openings (19) of the plugs or pillows or cushions.

10. Unit according to claim 9 wherein the plugs, pillows or cushions comprise an elastomer material including at least one of: rubber, compressible plastic.

11. Unit according to claim 1 wherein the separating plate (28) is secured in the housing structure intermediate the ends thereof, and separating the dynamo electric machine from the planetary gearing.

12. Unit according to claim 9 wherein the separating plate (28) comprises a sheet element secured in the housing and located adjacent the intermediate structure (10) and adjacent said plugs, pillows or cushions.

13. Unit according to claim 2 wherein the separating plate comprises a sheet element facing the open side of the cup shaped bearing shell to close off said open side thereof, and to separate the damping means from the dynamo electric machine of the unit.

14. Unit according to claim 3 wherein the separating plate comprises a sheet element facing the open side of the cup shaped bearing shell to close off said open side thereof, and to separate the damping means from the dynamo electric machine of the unit.

15. Unit according to claim 1 wherein the separating plate (28) comprises a sheet element positioned adjacent the planetary gearing, and located in a plane transverse to the axis of rotation of the sun gear thereof;

and wherein said sheet element (28) is formed with a ring bead (32) facing the planet wheels of the planetary gearing, and positioned at a radius which is at least approximately that of the roots of the gear teeth of the planet wheels at the position remote from the axis of rotation of the planet wheels about the sun gear.

16. Unit according to claim 14 wherein the separating plate (28) comprises a sheet element positioned adjacent the planetary gearing, and located in a plane transverse to the axis of rotation of the sun gear thereof;

and wherein said sheet element (28) is formed with a ring bead (32) facing the planet wheels of the planetary gearing and positioned at a radius which is at least approximately that of the roots of the gear teeth of the planet wheels at the position remote from the axis of rotation of the planet wheels about the sun gear.

* * * * *